US010562686B2

(12) United States Patent
Spivey, Sr. et al.

(10) Patent No.: US 10,562,686 B2
(45) Date of Patent: Feb. 18, 2020

(54) CARRIER FOR CONTAINERS

(71) Applicant: Graphic Packaging International, Inc., Atlanta, GA (US)

(72) Inventors: Raymond R. Spivey, Sr., Mableton, GA (US); Raymond S. Kastanek, Mead, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 266 days.

(21) Appl. No.: 15/591,517

(22) Filed: May 10, 2017

(65) Prior Publication Data

US 2017/0240329 A1 Aug. 24, 2017

Related U.S. Application Data

(62) Division of application No. 14/705,049, filed on May 6, 2015, now Pat. No. 9,676,535.

(Continued)

(51) Int. Cl.
*B65D 71/40* (2006.01)
*B65D 5/32* (2006.01)

(Continued)

(52) U.S. Cl.
CPC ..... *B65D 71/406* (2013.01); *B65B 5/028* (2013.01); *B65B 43/10* (2013.01); *B65B 61/14* (2013.01);

(Continued)

(58) Field of Classification Search
CPC ..... B65B 11/004; B65B 21/24; B65B 21/242; B65B 61/14; B65B 5/024; B65B 5/028;

(Continued)

(56) References Cited

U.S. PATENT DOCUMENTS 2,085,827 A 7/1937 Perreton
2,281,592 A 5/1942 O'Brien (Continued)

FOREIGN PATENT DOCUMENTS

EP 0 094 806 11/1983
EP 0 459 658 12/1991

(Continued)

OTHER PUBLICATIONS

International Search Report and Written Opinion for PCT/US2015/029355 dated Jul. 24, 2015.

(Continued)

*Primary Examiner* — Hemant Desai
*Assistant Examiner* — Jacob A Smith
(74) *Attorney, Agent, or Firm* — Womble Bond Dickinson (US) LLP

(57) ABSTRACT

A carton for holding a plurality of containers, the carton includes a top retainer having a top panel and at least one top end flap foldably connected to the top panel. The top panel includes at least one retaining portion having at least one receptacle for retaining at least one container of the plurality of containers, and the at least one retaining portion is removable from the carton. The carton further includes a tray having a bottom panel and at least one bottom end flap foldably connected to the bottom panel. The at least one top end flap and the at least one bottom end flap cooperate to form a closed end of the carton.

16 Claims, 11 Drawing Sheets

Related U.S. Application Data

(60) Provisional application No. 61/996,443, filed on May 7, 2014.

(51) Int. Cl.

| | |
|---|---|
| ***B65D 5/42*** | (2006.01) |
| ***B65D 5/468*** | (2006.01) |
| ***B65D 5/54*** | (2006.01) |
| ***B65B 43/10*** | (2006.01) |
| ***B65B 5/02*** | (2006.01) |
| ***B65D 71/54*** | (2006.01) |
| ***B65D 71/38*** | (2006.01) |
| ***B65D 71/72*** | (2006.01) |
| ***B65B 61/14*** | (2006.01) |
| ***B65D 5/44*** | (2006.01) |

(52) U.S. Cl.

CPC ..... *B65D 5/32* (2013.01); *B65D 5/321* (2013.01); *B65D 5/4266* (2013.01); *B65D 5/445* (2013.01); *B65D 5/4608* (2013.01); *B65D 5/5445* (2013.01); *B65D 71/0011* (2013.01); *B65D 71/38* (2013.01); *B65D 71/72* (2013.01); *B65D 2571/0045* (2013.01); *B65D 2571/0079* (2013.01); *B65D 2571/00141* (2013.01); *B65D 2571/00549* (2013.01); *B65D 2571/00666* (2013.01); *B65D 2571/00796* (2013.01); *B65D 2571/00814* (2013.01); *B65D 2571/00864* (2013.01); *B65D 2571/00882* (2013.01)

(58) Field of Classification Search

CPC ..... B65B 5/068; B65B 43/08; B65B 43/10; B65D 5/54; B65D 17/50; B65D 71/56; B65D 71/58; B65D 71/60

USPC ..... 43/398, 413, 410, 420, 416, 429, 433, 43/443, 448, 452, 456, 458, 462, 472, 43/478, 489, 48.1; 53/398, 413, 410, 53/420, 416, 429, 433, 443, 448, 452, 53/456, 458, 462, 472, 478, 489, 48.1; 229/117.6, 103.2

See application file for complete search history.

(56) References Cited

U.S. PATENT DOCUMENTS

| | | | | |
|---|---|---|---|---|
| 3,156,358 | A | 11/1964 | Randrup | |
| 3,747,835 | A | 7/1973 | Graser | |
| 3,767,042 | A | 10/1973 | Ganz | |
| 3,780,906 | A | 12/1973 | Katzenmeyer | |
| 3,881,648 | A | 5/1975 | Hall | |
| 3,963,121 | A | 6/1976 | Kipp | |
| 3,964,607 | A | 6/1976 | Wagner | |
| 4,256,226 | A | 3/1981 | Stone | |
| 4,304,329 | A | 12/1981 | Graser | |
| 4,424,901 | A | 1/1984 | Lanier | |
| 4,471,870 | A | 9/1984 | Uhlig | |
| 4,708,284 | A | 11/1987 | Sutherland et al. | |
| 4,875,585 | A | 10/1989 | Kadleck et al. | |
| 4,913,291 | A | 4/1990 | Schuster | |
| 4,925,019 | A | 5/1990 | Ganz et al. | |
| 5,042,660 | A | 8/1991 | Carver | |
| 5,297,673 | A | 3/1994 | Sutherland | |
| 5,351,815 | A | 10/1994 | Fogle et al. | |
| 5,377,862 | A | 1/1995 | Oakes et al. | |
| 5,400,901 | A | 3/1995 | Harrelson | |
| 5,485,915 | A | 1/1996 | Harris | |
| 5,549,197 | A | 8/1996 | Sutherland | |
| 5,590,776 | A * | 1/1997 | Galbierz | B65D 71/44 206/153 |
| 5,595,291 | A | 1/1997 | Negelen | |
| 5,609,251 | A | 3/1997 | Harris | |
| 5,813,540 | A * | 9/1998 | Vollbrecht | B65D 5/2019 206/427 |
| 5,845,776 | A | 12/1998 | Galbierz | |
| 5,853,088 | A | 12/1998 | Saulas et al. | |
| 5,941,389 | A | 8/1999 | Gomes | |
| 5,975,287 | A | 11/1999 | Negelen | |
| 6,371,365 | B1 | 4/2002 | Doucette et al. | |
| 6,378,697 | B1 | 4/2002 | Sutherland et al. | |
| 6,658,815 | B1 | 12/2003 | Gaspar | |
| 6,814,228 | B2 | 11/2004 | Sutherland | |
| 6,877,600 | B2 | 4/2005 | Sutherland | |
| 6,981,631 | B2 | 1/2006 | Fogle et al. | |
| 7,175,020 | B2 | 2/2007 | Sutherland et al. | |
| 7,374,038 | B2 | 5/2008 | Smalley | |
| 7,793,779 | B2 | 9/2010 | Spivey, Sr. | |
| 7,832,621 | B2 * | 11/2010 | Smalley | B65D 71/36 206/427 |
| 7,959,062 | B2 * | 6/2011 | Auclair | B65D 5/324 206/427 |
| 8,387,784 | B2 * | 3/2013 | Gonzalez | B65D 71/42 206/153 |
| 8,602,209 | B2 | 12/2013 | Jones et al. | |
| 8,622,207 | B2 | 1/2014 | Smalley | |
| 9,193,521 | B2 | 11/2015 | Wilhelm | |
| 2002/0112973 | A1 | 8/2002 | Sutherland | |
| 2005/0001020 | A1 | 1/2005 | Garnier | |
| 2006/0283744 | A1 * | 12/2006 | Kruit | B65B 5/024 206/427 |
| 2008/0190785 | A1 * | 8/2008 | Spivey | B65D 71/066 206/147 |
| 2008/0230406 | A1 * | 9/2008 | Cuomo | B65D 71/0014 206/175 |
| 2008/0257942 | A1 * | 10/2008 | LeBras | B65D 71/38 229/117.13 |
| 2010/0078337 | A1 * | 4/2010 | Sutherland | B65D 71/44 206/148 |
| 2010/0175351 | A1 * | 7/2010 | Hand | B65D 71/36 53/456 |
| 2010/0264043 | A1 * | 10/2010 | De Paula | B65D 71/42 206/199 |
| 2011/0016831 | A1 * | 1/2011 | Huber | B65B 5/068 53/448 |
| 2011/0132978 | A1 | 6/2011 | De Sousa | |
| 2011/0226845 | A1 * | 9/2011 | DePaula | B65D 71/42 229/103.2 |
| 2011/0284623 | A1 * | 11/2011 | Jones | B65D 71/46 229/103.2 |
| 2012/0067755 | A1 * | 3/2012 | Spivey, Sr. | B65D 71/36 206/427 |
| 2013/0256392 | A1 * | 10/2013 | Kohler | B65D 5/72 229/117.12 |
| 2013/0292285 | A1 * | 11/2013 | Kastanek | B65D 71/18 206/433 |
| 2014/0021071 | A1 * | 1/2014 | Alexander | B65B 5/024 206/139 |
| 2014/0021080 | A1 * | 1/2014 | Fitzwater | B65B 5/024 206/427 |
| 2014/0027318 | A1 * | 1/2014 | Sutherland | B65D 71/42 206/147 |
| 2014/0042215 | A1 * | 2/2014 | Sutherland | B65D 5/4608 229/117.15 |
| 2014/0174976 | A1 | 6/2014 | Ramberg et al. | |
| 2017/0240329 | A1 * | 8/2017 | Spivey, Sr. | B65D 71/72 |

FOREIGN PATENT DOCUMENTS

| | | |
|---|---|---|
| FR | 2 292 640 A1 | 6/1976 |
| FR | 2 412 473 | 7/1979 |
| WO | WO 94/02380 | 2/1994 |

OTHER PUBLICATIONS

Office Action for U.S. Appl. No. 14/705,049 dated Nov. 25, 2015.
Response to Restriction Requirement for U.S. Appl. No. 14/705,049 dated Jan. 25, 2016.
Office Action for U.S. Appl. No. 14/705,049 dated Mar. 15, 2016.

(56) References Cited

OTHER PUBLICATIONS

Amendment A and Response to Office Action for U.S. Appl. No. 14/705,049 dated Jun. 15, 2016.
Office Action for U.S. Appl. No. 14/705,049 dated Jul. 25, 2016.
Amendment B and Response to Office Action for U.S. Appl. No. 14/705,049 dated Oct. 12, 2016.
Office Action for U.S. Appl. No. 14/705,049 dated Dec. 9, 2016.
Amendment C and Response to Final Office Action for U.S. Appl. No. 14/705,049 dated Feb. 3, 2017.
Notice of Allowance and Fee(s) Due for U.S. Appl. No. 14/705,049 dated Feb. 17, 2017.
Issue Fee Transmittal Form for U.S. Appl. No. 14/705,049 dated May 10, 2017.
Supplementary European Search Report for EP 15 78 9721 dated Dec. 1, 2017.

* cited by examiner

CARRIER FOR CONTAINERS

CROSS-REFERENCE TO RELATED APPLICATION

This application is a divisional application of U.S. patent application Ser. No. 14/705,049, filed May 6, 2015, which claims the benefit of U.S. Provisional Patent Application No. 61/996,443, filed May 7, 2014.

INCORPORATION BY REFERENCE

The disclosures of U.S. patent application Ser. No. 14/705,049, which was filed May 6, 2015, and U.S. Provisional Patent Application No. 61/996,443, which was filed May 7, 2014, are hereby incorporated by reference as if presented herein in their entirety.

BACKGROUND OF THE DISCLOSURE

The present disclosure generally relates to packages or cartons for holding and carrying containers.

SUMMARY OF THE DISCLOSURE

In general, one aspect of the disclosure is generally directed to a carton for holding a plurality of containers. The carton comprises a top retainer comprising a top panel and at least one top end flap foldably connected to the top panel. The top panel comprises at least one retaining portion having at least one receptacle for retaining at least one container of the plurality of containers, and the at least one retaining portion is removable from the carton. The carton further comprises a tray having a bottom panel and at least one bottom end flap foldably connected to the bottom panel. The at least one top end flap and the at least one bottom end flap cooperate to form a closed end of the carton.

In another aspect, the disclosure is generally directed to a top retainer blank and a tray blank for forming a carton for holding a plurality of containers. The top retainer blank includes a top panel and at least one top end flap foldably connected to the top panel. The top panel comprises at least one retaining portion having at least one receptacle for retaining at least one container of the plurality of containers in the carton formed from the top retaining blank and the tray blank. The at least one retaining portion is removable from the top retainer blank. The tray blank includes a bottom panel and a least one bottom end flap foldably connected to the bottom panel. The at least one top end flap and the at least one bottom end flap cooperate to form a closed end of the carton formed from the top retainer blank and the tray blank.

In another aspect, the disclosure is generally directed to a method of forming a carton for containing a plurality of containers. The method comprises obtaining a top retainer blank comprising a top panel and at least one top end flap foldably connected to the top panel. The top panel includes at least one retaining portion having at least one receptacle for retaining at least one container of the plurality of containers. The at least one retaining portion is removable from the top retainer blank. The method further comprises obtaining a tray blank having a bottom panel and at least one bottom end flap foldably connected to the bottom panel, forming a tray from the tray blank and positioning the plurality of containers on the bottom panel of the tray formed from the tray blank. The method further comprises forming a top retainer from the top retaining blank and positioning the top retainer and attaching the at least one container to the retaining portion by contact of the at least one container with the receptacle, and closing an end of the carton by positioning the at least one top end flap and the at least one bottom end flap to form a closed end of the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

FIG. 1 is an exterior plan view of a blank for forming a top retainer of the carton according to a first embodiment of the disclosure.

Corresponding parts are designated by corresponding reference numbers throughout the drawings.

DETAILED DESCRIPTION OF THE EXEMPLARY EMBODIMENTS

Figure 7:
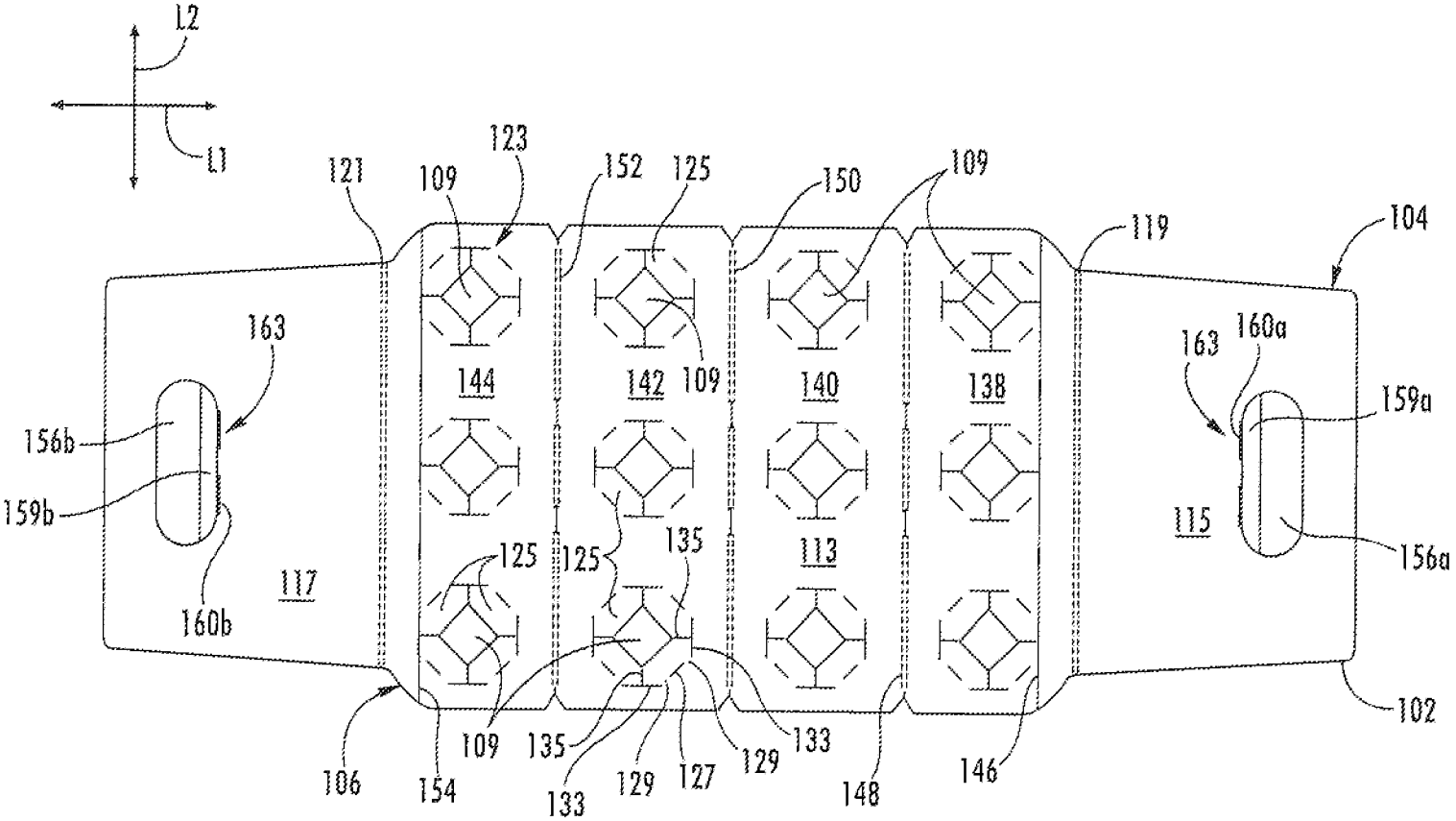
FIG. 7A is an exterior plan view of a blank for forming a top retainer of a carton according to a fourth embodiment of the disclosure.
FIG. 7B is an illustration of a retaining portion being removed from the carton according to the fourth embodiment of the disclosure.
FIG. 7C is an illustration of a retaining portion removed from the carton according to the fourth embodiment of the disclosure.

The present disclosure generally relates to cartons for containing articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of numerous different shapes. For the purpose of illustration and not for the purpose of limiting the scope of the disclosure, the following detailed description describes beverage containers (e.g., glass, plastic, or metal beverage bottles) at least partially disposed within the carton embodiments. In this specification, the terms "lower," "bottom," "upper" and "top" indicate orientations determined in relation to fully erected and upright cartons.

The present embodiments illustrated in FIGS. 1-7C are addressed to cartons or packages for attachment to and accommodation of containers. A carton or carrier 100 is illustrated in its erected state in FIG. 3, in which containers C are attached and arranged in four rows of three containers. In the illustrated embodiments the containers C are illustrated as beverage containers having a top portion generally comprising a flange portion F, an upper neck portion N, and a cap CP, and a bottom portion B, but containers of other sizes, shapes, and configurations, may be held in the carton 100 without departing from the disclosure. The carton 100 comprises a tray 164 that supports the bottom portions B of the containers and a top retainer 106 that is attached to the top portions of the containers. The upper neck portions N of the containers C are received in respective receptacles 123 in the top retainer 106 of the carton 100 and retained in the carton by retaining features described further herein. The containers C could be arranged in other than a 4×3 arrangement (e.g., 2×3, 1×3, 6×4, etc.) without departing from the disclosure. In the illustrated embodiment, the carton 100 includes handles 111, 112 (FIG. 3) for grasping and carrying the carton. The handles 111, 112 include various features including reinforcement features as further described herein.

FIG. 1 is a plan view of the exterior side 102 of a blank, generally indicated at 104, used to form the top retainer 106 of a carton 100 (FIG. 3) according to an exemplary embodiment of the disclosure. The blank 104 has a longitudinal axis L1 and a lateral axis L2. The blank 104 comprises a top panel 113 removably connected to first and second top end flaps 115, 117 at lateral tear lines 119, 121, respectively.

In the illustrated embodiment, the blank 104 includes twelve receptacles 123, each of the receptacles include an opening 109 with four support tabs 125 extending therein. The support tabs 125 are respectively at least partially defined by cuts 127 (e.g., slits) in the top panel 113 and are foldably connected to the top panel 113 by respective connectors that may be characterized as nicks 129. The nicks 129 are located at respective ends of the cuts 127. The nicks 129 are areas of material in the top panel that are typically free from cuts, and at least initially are free of fold lines or other lines of weakness. The nicks 129 are adjacent respective cuts 133 (e.g., slits) that extend from one of the nicks to slits 135. Slits 135 separate the tabs 125. In accordance with the illustrated embodiment and for example, a continuous slit would be collectively formed by the cuts 127, 133, except that that continuous slit is interrupted by the nicks 129. The openings 109 and the tabs 125 could be otherwise shaped, arranged, and/or configured without departing from the disclosure.

As shown in FIG. 1, the tabs 125 surrounding each opening 109 are of similar sizes so that when containers C are inserted into the openings 109, the tabs 125 are upwardly struck from the top panel 113. Each of the tabs 125 contacts the underside of the flanges F to support the containers when the carrier is lifted. A variety of different configurations of tabs (e.g., tabs 125) are within the scope of this disclosure.

As illustrated in FIG. 1, the top panel 113 comprises retaining portions 138, 140, 142, and 144. Each of the retaining portions (138, 140, 142, and 144) have 3 receptacles 123 and each of the retaining portions are defined by respective tear lines 148, 150 and 152 that extend across the top panel 113. The first retaining portion 138 is removably connected to the second retaining portion 140 along tear line 148. The third retaining portion 142 is removably connected to the second retaining portion 140 along tear line 150 and to the fourth retaining portion 144 along tear line 152. The fourth retaining portion 144 is removably connected to the end panel 117 along tear line 121 and the first retaining portion 138 is removably connected to the end panel 115 along tear line 119. The tear lines 119, 121, 148, 150 and 152 separate the retaining portions 138, 140, 142, and 144 into removable sections of receptacles 123 in a 1×3 arrangement. As shown in FIG. 1, the first retaining portion 138 and fourth retaining portion 144 may include lateral fold lines 146 and 154 that extend laterally across the respective retaining portions and are in alignment with the cuts 133 along outer edges of the receptacles 123. After the carton is formed, one or more of the retaining portions 138, 140, 142, and 144 may be removed in a modular fashion leaving the remaining retaining portions secured to the overall carton 100.

In one embodiment, the handle features for forming the first handle 111 include a first handle opening 156*a* in the first top end flap 115 and a reinforcement flap 159*a* foldably connected to the first top end flap 115 at a lateral fold line 160*a*. The handle features for forming the second handle 112 include a second handle opening 156*b* in the second top end flap 117 and a reinforcement flap 159*b* foldably connected to the second top end flap 117 at a lateral fold line 160*b*. The handle features may also include reinforcing string (i.e., reinforcing tear tape) 163 on the interior side of the blank that reinforce the handle and prevent tearing. The reinforcing string is adjacent the fold lines 160*a*, 160*b* and extend laterally along the width of the top end flaps 115, 117. The reinforcing string 163 may be used to reinforce low caliper blank materials (e.g., paperboard, cardboard, paper, or a polymeric sheet); however the reinforcement string 163 is not required. The handle features could be otherwise shaped, arranged, configured, and/or omitted without departing from the disclosure.

Figure 2:
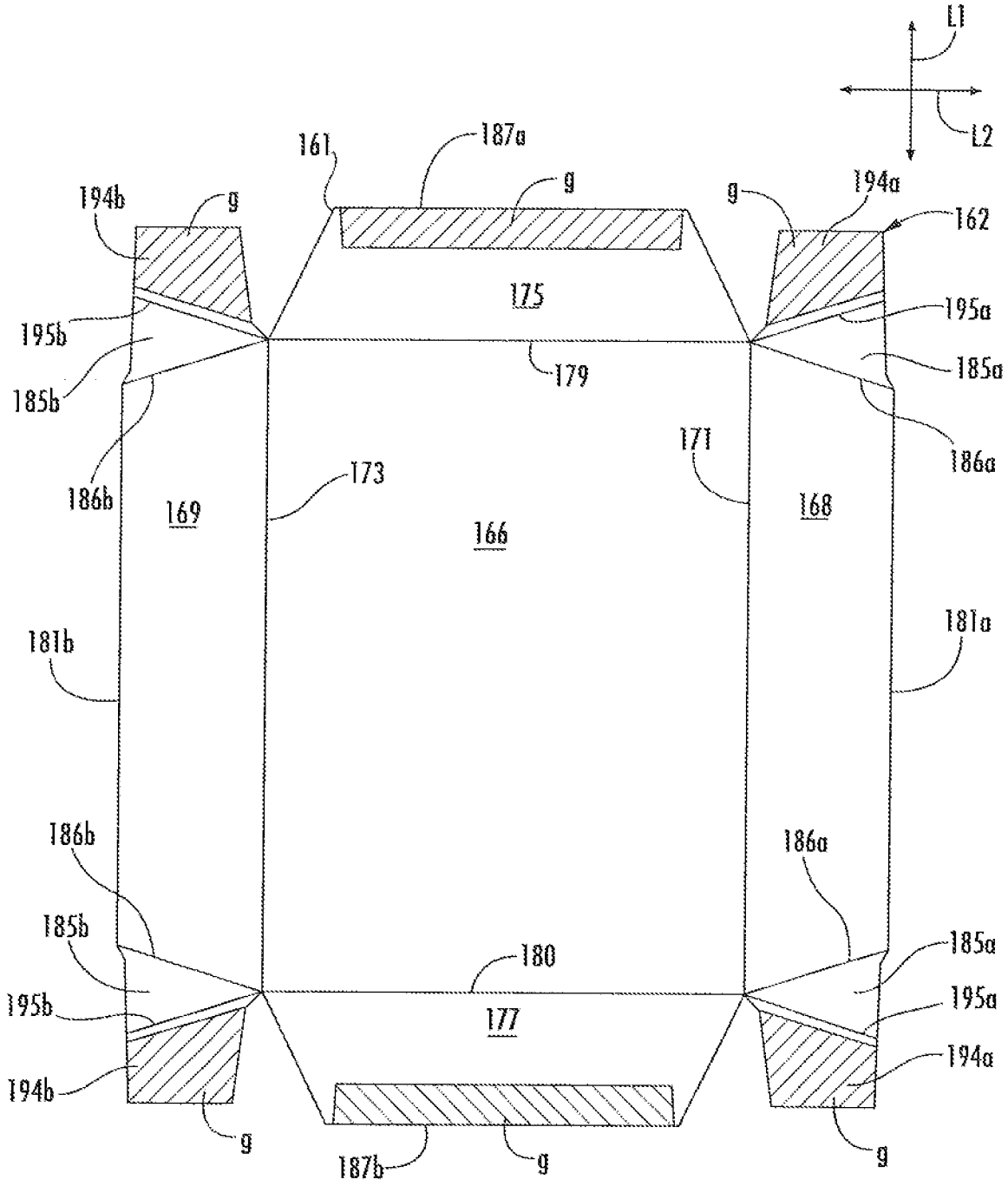
FIG. 2 is an exterior plan view of a blank for forming a tray according to the first embodiment of the disclosure.
Figure 3:
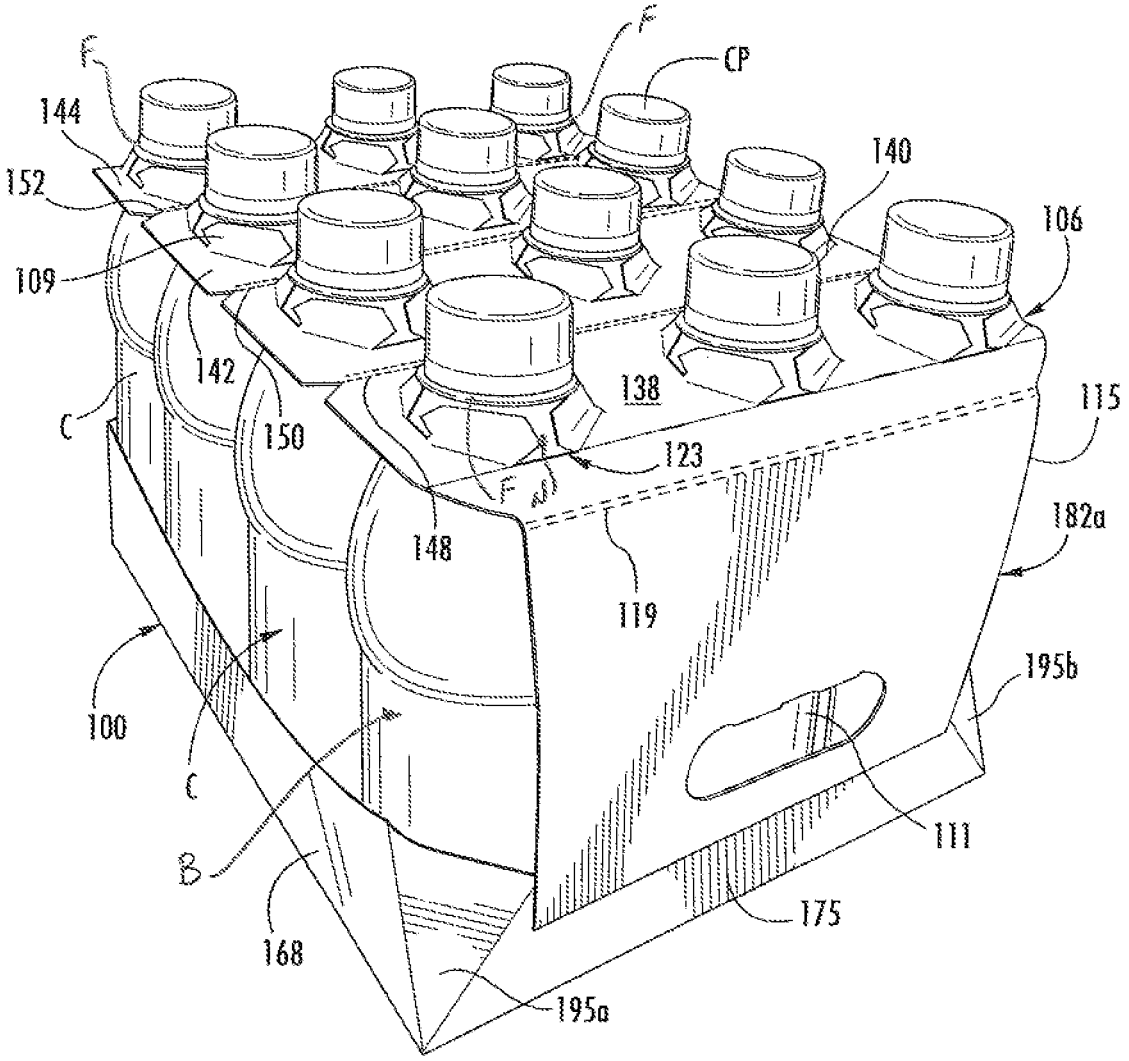
FIG. 3 is a perspective view of the carton according to the first embodiment of the disclosure.

FIG. 2 is a plan view of the exterior side 161 of a blank, generally indicated at 162, used to form the tray 164 of a carton 100 (FIG. 3) according to an exemplary embodiment of the disclosure, the blank 162 has a longitudinal axis L1 and a lateral axis L2. The blank 162 comprises a bottom panel 166 foldably connected to first and second side panels 168, 169 at longitudinal fold lines 171, 173 respectively; and first and second bottom end flaps 175, 177 foldably connected to the bottom panel 166 at a lateral fold lines 179, 180 respectively. In one embodiment, each of the side panels 168, 169 may have a respective free edge 181*a*, 181*b* that has a length shorter than the edge of the side panels that are attached to the bottom panel 166 along fold lines 171 and 173. Similarly, each of the first and second bottom end flaps 175, 177 may have a respective free edge 187*a*, 187*b* that has a length shorter than the edge of the bottom end flaps that are attached to the bottom panel 166 along fold lines 179 and 180. When the carton 100 is formed, the top end flap 115, 117 of the top retainer 106 can at least partially overlap the bottom end flap 175, 177 of the tray 164 to form closed ends 182*a*, 182*b* respectively (FIG. 3).

As shown in FIG. 2, the first side panel 168 of the tray 164 is foldably connected to two gusset panels 185*a* along oblique fold lines 186*a* and the second side panel 169 is foldably connected to two gusset panels 185*b* along oblique fold lines 186*b*. The gusset panels 185*a* are each foldably connected to an attachment flap 194*a* along oblique fold line 195*a* and the gusset panels 185*b* are each foldably connected to an attachment flap 194*b* along oblique fold line 195*b*. The gusset panels 185*a*, 185*b* are generally v-shaped and defined by the respective oblique fold lines 186*a*, 195*a*, 186*b*, and 195*b*.

An exemplary method of forming the carton 100 from blanks 104 and 162 is discussed in detail below. At various stages in the method for forming, respective portions of the blanks 104 and 162 are mounted to one another in any suitable manner. For example, glue or other adhesive material may be applied at various portions of the blanks 104, 162 indicated by "g" and/or present where appropriate surfaces of the blank are in face-to-face contact.

To form the carton 100 in accordance with one acceptable method, the tray 164 is first formed from the tray blank 162 by positioning the exterior surface 161 of the tray blank 162 facing down. First the bottom end flaps 175 and 177 are folded upwardly about fold lines 179, 180 and side panels 168, 169 are folded upwardly about fold lines 171, 173. The attachment flaps 194*a*, 194*b* are then positioned in face-to-face contact with the bottom end flaps 175, 177, respectively. Glue can be applied to portions "g" of the attachment flaps 194*a*, 194*b* to adhesively secure the attachments flaps to the side panels 175, 177, respectively and form the tray 164.

Containers C (e.g., bottles) may be loaded into the tray 164. Then the receptacles 123 of the retainer blank 104 are aligned with the caps CP of the containers and the retainer blank is pushed down over the tops of the containers, or alternatively, the containers can be moved relative to the blank 104 to retain the containers in the receptacles 123. As the caps CP of the containers C enter the receptacles 123, the caps contact the support tabs 125 and pivot the support tabs up relative to the top panel 113 to further open the openings 109 in the top panel (FIG. 3). Relative upward movement of the containers C continues until the support tabs 125 "snap" into place as the edges of these tabs engage the underside of the flanges F (FIG. 3). Next, the top end flap 115, 117 are folded down about tear lines 119, 121 and into face-to-face contact with the bottom end flaps 175, 177, respectively. Glue can be applied to portions "g" of the bottom end flaps 175, 177 to adhesively secure the bottom end flaps 175, 177 to the top end flaps 115, 117, respectively, to produce the final carton 100 shown in FIG. 3. Alternatively the top retainer 106 can be formed and attached to the containers prior to loading the containers in the tray 164.

Figure 4A:
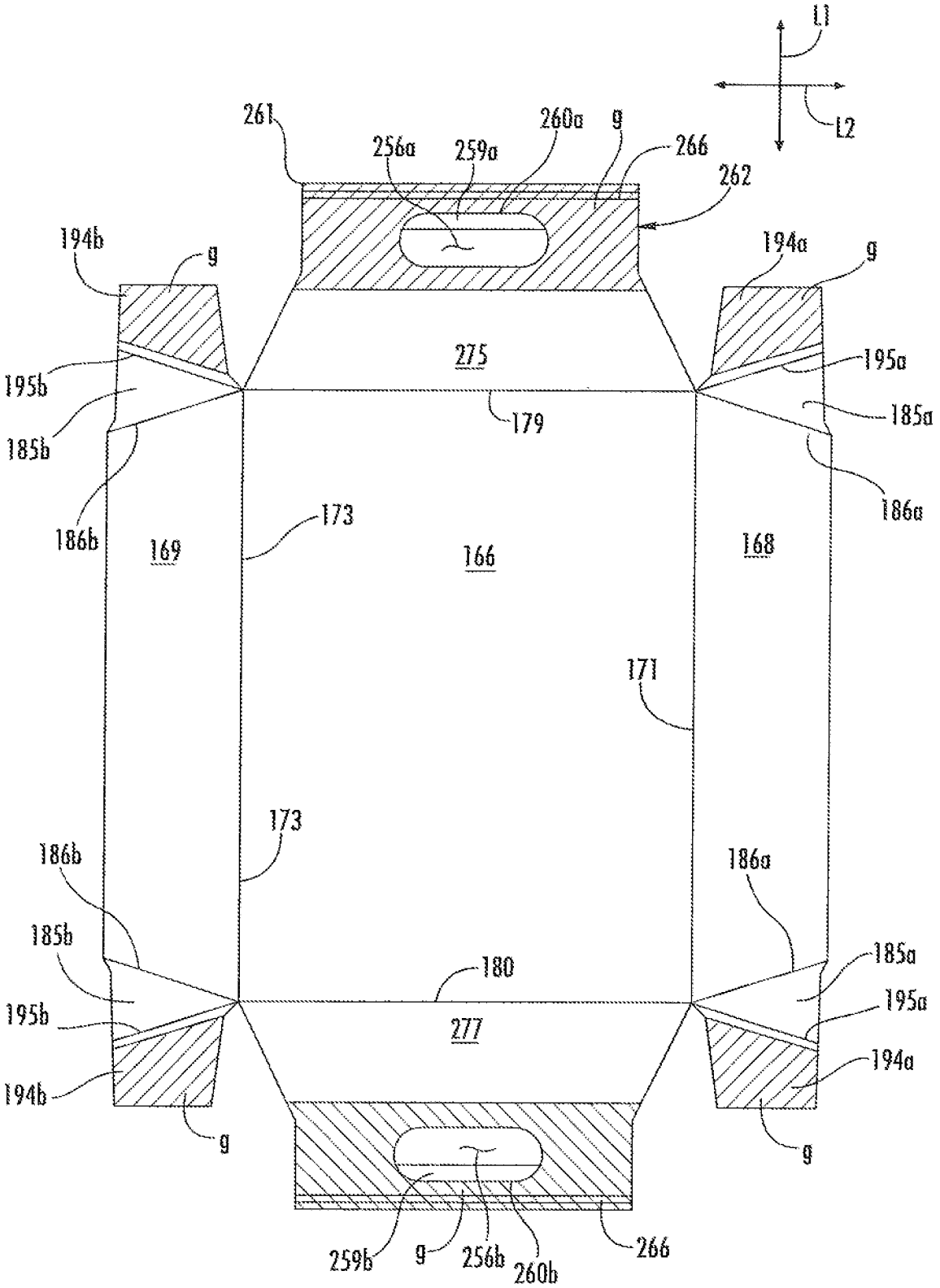
FIG. 4A is an exterior plan view of a blank for forming a tray of the carton according to a second embodiment of the disclosure.

FIG. 4A is a plan view of the exterior side 261 of a blank, generally indicated at 262, used to form the tray 264 of carton 200 (FIG. 4B) according to a second embodiment of the disclosure. Accordingly, similar or identical features of the embodiments are provided with like reference numbers. The tray blank 262 has a longitudinal axis L1 and a lateral axis L2. The blank 262 comprises a bottom panel 166 foldably connected to first and second side panels 168, 169 at longitudinal fold lines 171, 173 respectively; and first and second bottom end flaps 275, 277 foldably connected to the bottom panel 166 at a lateral fold lines 179, 180, respectively.

As shown in FIG. 4A, the first side panel 168 of the tray 264 is foldably connected to two gusset panels 185*a* along oblique fold lines 186*a* and the second side panel 169 is foldably connected to two gusset panels 185*b* along oblique fold lines 186*b*. The gusset panels 185*a* are each foldably connected to an attachment flap 194*a* along oblique fold line 195*a* and the gusset panels 185*b* are each foldably connected to an attachment flap 194*b* along oblique fold line 195*b*.

In one embodiment, the tray 264 may comprise handle features for forming handles 271*a*, 271*b* of the carton 200. The handle features include a first handle opening 256*a* in the first bottom end flap 275 and a reinforcement flap 259*a* foldably connected to the first bottom end flap 275 at a lateral fold line 260*a*. The handle features include a second handle opening 256*b* in the second bottom end flap 277 and a reinforcement flap 259*b* foldably connected to the second bottom end flap 277 at a lateral fold line 260*b*. The handle features may also include reinforcing string (e.g., reinforcing tear tape) 266 on the interior side of the blank 262 spaced apart from the fold lines 260*a*, 260*b* and extending laterally along the width of the bottom end flaps 275, 277. The reinforcing string 266 may be used to reinforce low caliper materials; however the reinforcement string 266 is not required.

Alternatively, to form the carton 200 from retainer blank 104 and tray blank 262 in accordance with one acceptable method, the tray 264 is first formed from the tray blank 262 by positioning the exterior surface 261 of the tray blank 262 facing down. First the bottom end flaps 275 and 277 are folded about fold lines 179, 180 and side panels 168, 169 are fold about fold lines 171, 173. The attachment flaps 194*a*, 194*b* are positioned in face-to-face contact with the bottom end flaps 275, 277, respectively. Glue can be applied to portions "g" of the attachment flaps 194*a*, 194*b* to adhesively secure the attachments flaps to the side panels 275, 277, respectively and form the tray 164.

Figure 4B:
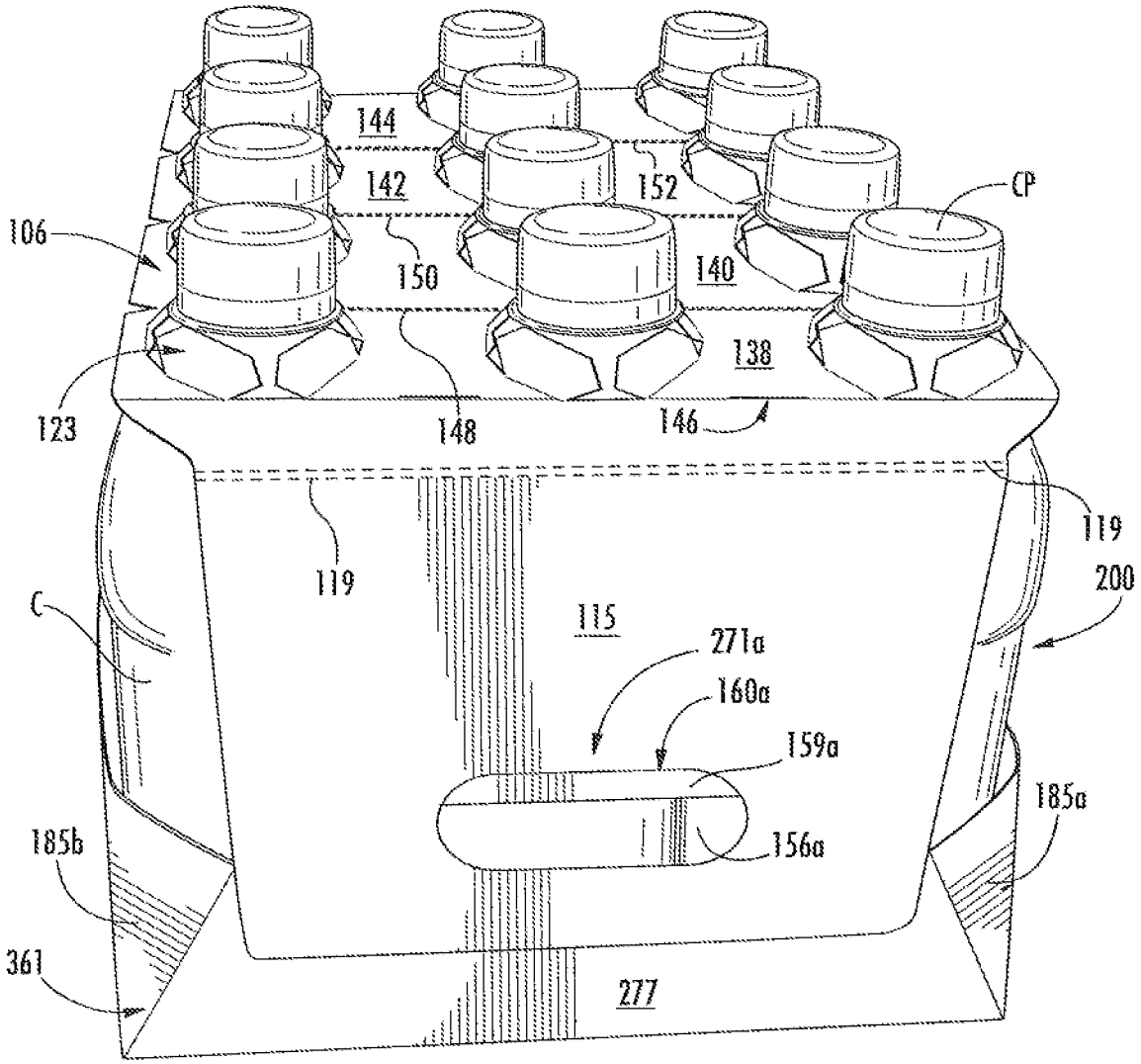
FIG. 4B is perspective view of the carton according to the second embodiment of the disclosure.

Containers (e.g., bottles) may be loaded onto the tray 264. Then the openings 109 of the receptacles 123 of the retainer blank 104 are aligned with the caps CP of the containers and the retainer blank is pushed down over the tops of the containers or alternatively, the containers can be moved relative to the retainer blank and positioned within the openings 109 to retain the containers in the receptacles 123. As the caps CP of the containers C enter the openings 109 of the receptacles 123, the caps contact the support tabs 125 and pivot the support tabs up relative to the top panel 113 to increase the size of the openings 109 in the top panel. Relative upward movement of the containers C continues until the support tabs 125 snap into place as the edges of these tabs engage the underside of the flanges F. Next, the top end flaps 115, 117 are folded downwardly about tear lines 119, 121 such that the handle openings 256*a*, 256*b* of the tray 264 are aligned with the handle openings 156*a*, 156*b* of the top retainer 106 and the top end flaps 115, 117 are in face-to-face contact with the bottom end flaps 275, 277, respectively. Glue can be applied to portions "g" of the bottom end flaps 275, 277 to adhesively secure the bottom end flaps 275, 277 to the top end flaps 115, 117, respectively, to produce the final carton 200 (FIG. 4*b*). Alternatively the top retainer 106 can be formed with the containers prior to loading the containers in the tray 264.

Figure 5:
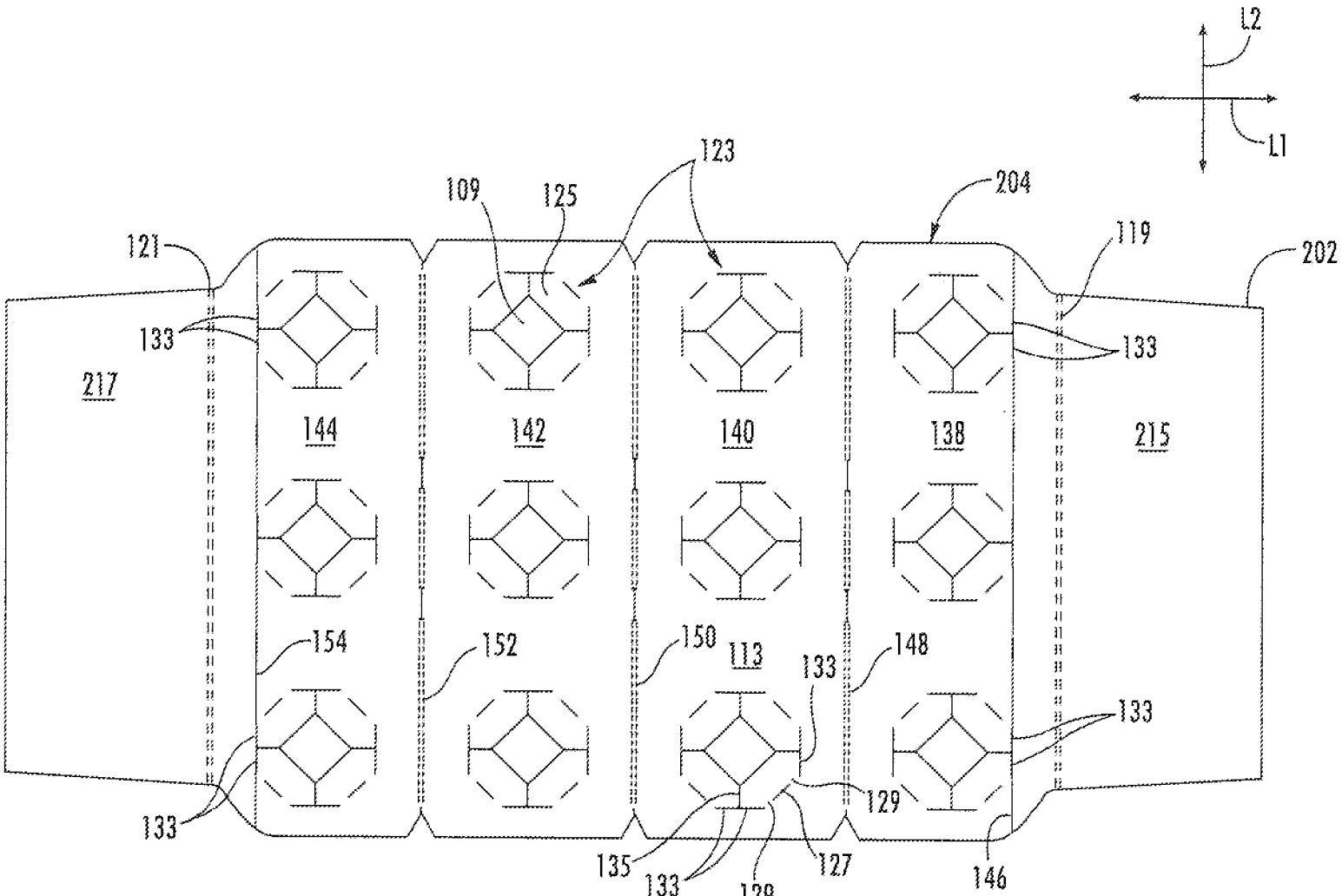
FIG. 5 is an exterior plan view of a blank for forming a top retainer of a carton according to a third embodiment of the disclosure.

FIG. 5 is a plan view of the exterior side 202 of a blank, generally indicated at 204, used to form the top retainer 206 of a carton 300 (FIG. 6B) according to a third embodiment of the disclosure. Accordingly, similar or identical features of the embodiments are provided with like reference numbers. The blank 204 has a longitudinal axis L1 and a lateral axis L2. The blank 204 comprises a top panel 113 removably connected to first and second top end flaps 215, 217 at lateral tear lines 119, 121, respectively. The top end flaps 215, 217 are free from handle features.

In the illustrated embodiment, the blank 204 includes twelve receptacles 123. Each of the receptacles 123 include an opening 109 with support tabs 125 extending therein. The support tabs 125 are respectively at least partially defined by cuts 127 (e.g., slits) in the top panel 113 and the tabs 125 are foldably connected to the top panel 113 by respective connectors or nicks 129. The nicks 129 are located at respective ends of the cuts 127. The nicks 129 are areas of material in the top panel that are typically free from cuts, and at least initially are free of fold lines or other lines of weakness. The nicks 129 are adjacent respective cuts 133 (e.g., slits) that extend from one of the nicks to slits 135. Slits 135 separate the tabs 125. In accordance with the illustrated embodiment and for example, a continuous slit would be collectively formed by the cuts 127, 133, except that that continuous slit is interrupted by the nicks 129. The openings 109 and the tabs 125 could be otherwise shaped, arranged, and/or configured without departing from the disclosure.

As shown in FIG. 5, the tabs 125 extending into each opening 109 are of similar sizes so that when containers C are inserted into the openings 109, the tabs 125 are upwardly struck from the top panel 113, and each of tabs 125 contact the underside of the flanges F to support the containers when the carrier is lifted. A variety of different configurations of tabs (e.g., tabs 125) are within the scope of this disclosure.

Figure 6A:
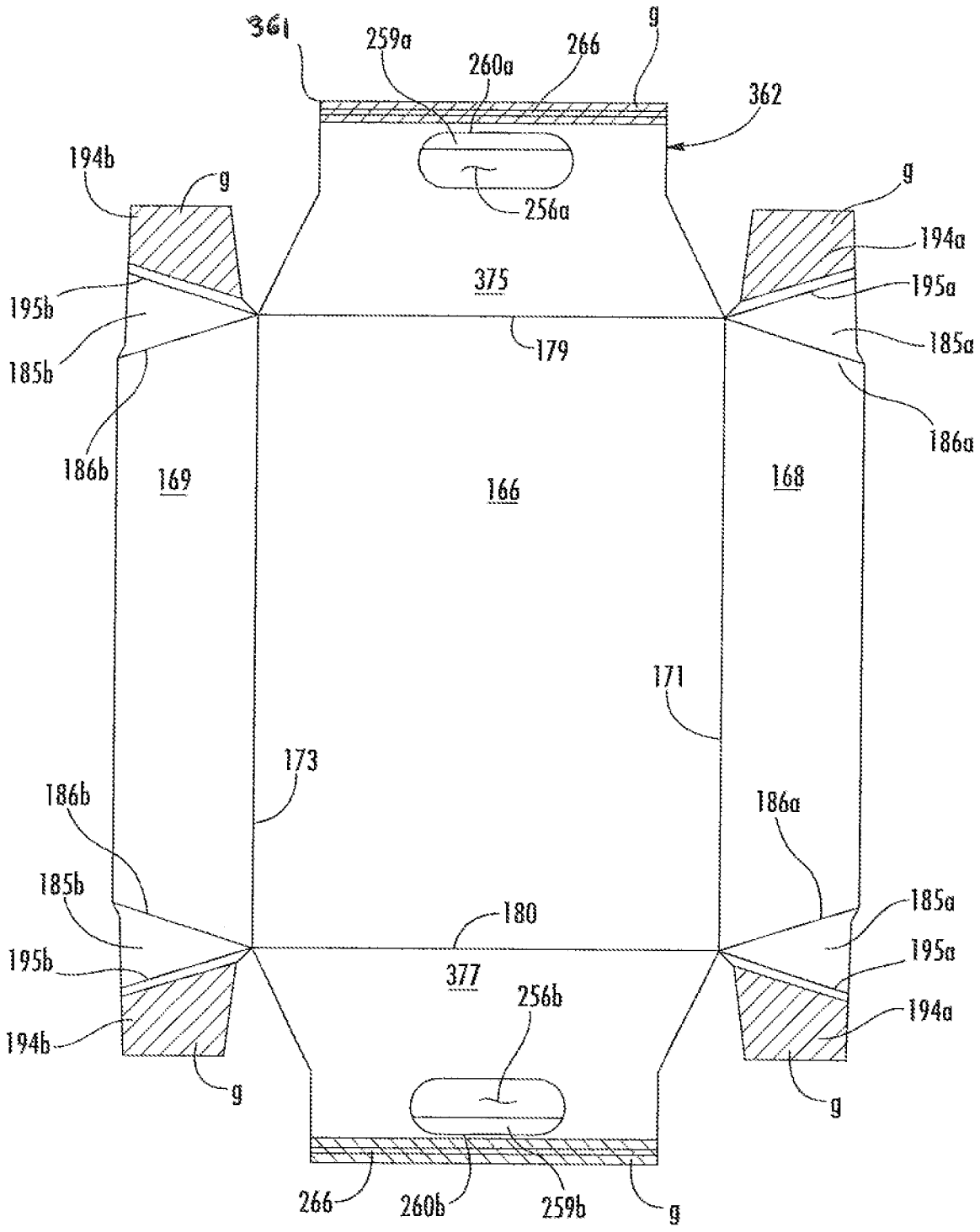
FIG. 6A is an exterior plan view of a blank for forming a tray of the carton according to the third embodiment of the disclosure.
Figure 6B:
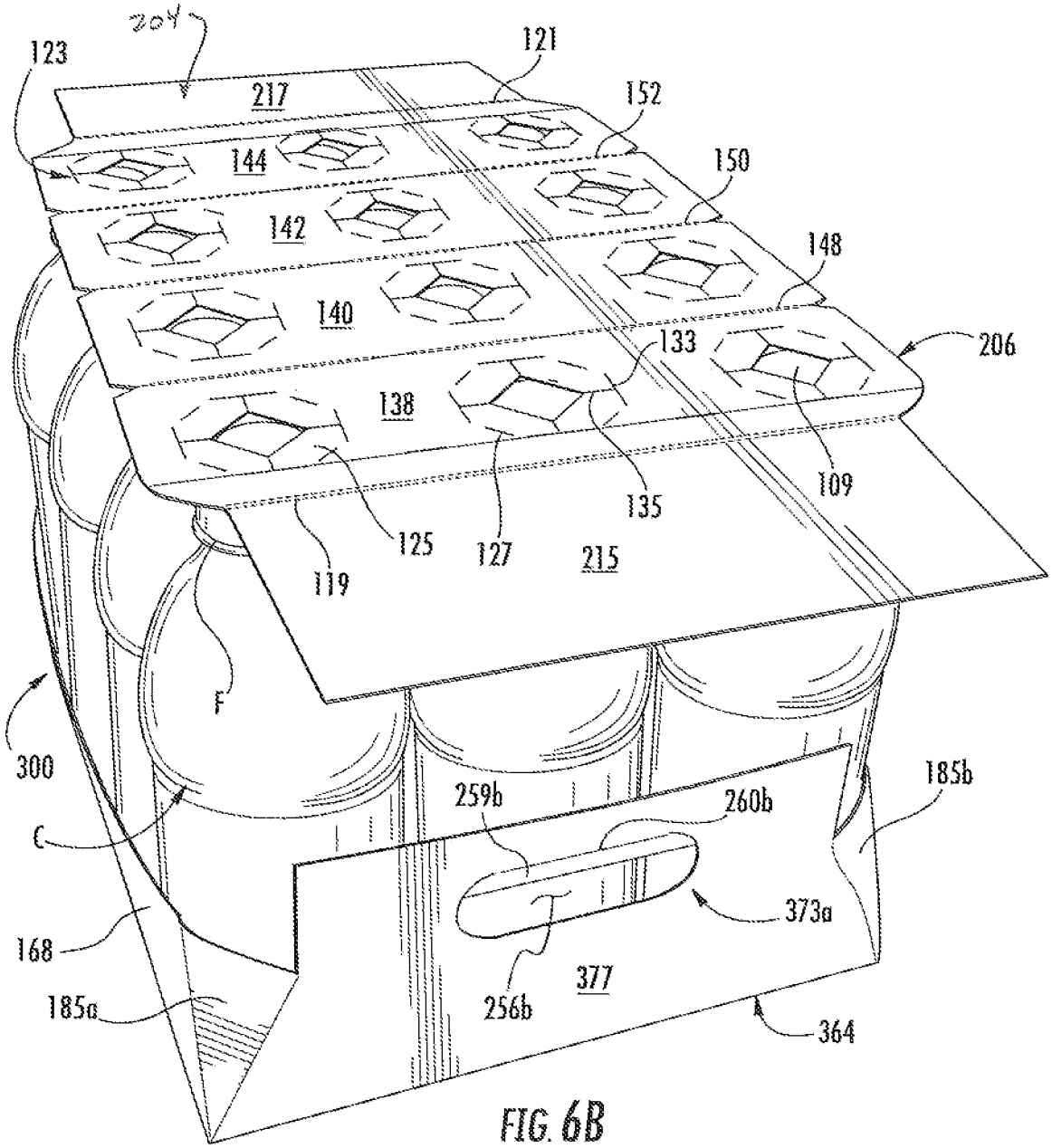
FIG. 6B is a perspective view of the carton partially formed according to the third embodiment of the disclosure.

FIG. 6A is a plan view of the exterior side 361 of a blank, generally indicated at 362, used to form the tray 364 of carton 300 (FIG. 6B) according to a third embodiment of the disclosure. The blank 362 has a longitudinal axis L1 and a lateral axis L2. The blank 362 comprises a bottom panel 166 foldably connected to first and second side panels 168, 169 at longitudinal fold lines 171, 173 respectively; and first and second bottom end flaps 375, 377 foldably connected to the bottom panel 166 at a lateral fold lines 179, 180, respectively.

As shown in FIG. 6A, the first side panel 168 of the tray 364 is foldably connected to two gusset panels 185*a* along oblique fold lines 186*a* and the second side panel 169 is foldably connected to two gusset panels 185*b* along oblique fold lines 186*b*. The gusset panels 185*a* are each foldably connected to an attachment flap 194*a* along oblique fold line 195*a* and the gusset panels 185*b* are each foldably connected to an attachment flap 194*b* along oblique fold line 195*b*.

In one embodiment, the tray 364 may comprise handle features for forming handles 373*a*, 373*b* in the carton 300. The handle features include a first handle opening 256*a* in the first bottom end flap 375 and a reinforcement flap 259*a* foldably connected to the first bottom end flap 375 at a lateral fold line 260*a*. The handle features include a second handle opening 256*b* in the second bottom end flap 377 and a reinforcement flap 259*b* foldably connected to the second bottom end flap 377 at a lateral fold line 260*b*. As shown in FIG. 6A, the handle features may also include reinforcing string (i.e., reinforcing tear tape) 266 on the interior side of the blank that reinforce the handle and prevent tearing. The reinforcing string 266 may be spaced apart from the fold lines 260*a*, 260*b* and extend laterally along the width of the bottom end flaps 375, 377. The reinforcing string 266 may be used to reinforce low caliper materials; however the reinforcement string 266 is not required.

An exemplary method of forming the carton 300 comprising a retainer blank 204 and a tray blank 362 is discussed in detail below. At various stages in the method for forming, respective portions of the blanks 204 and 362 are mounted to one another in any suitable manner. For example, at various stages of the carton forming process, glue or other adhesive material can be applied at various portions of the blanks 204, 362. For example, the adhesive material may be indicated by "g" and/or present where appropriate surfaces of the blank are in face-to-face contact.

To form the carton 300 in accordance with one acceptable method, the tray 364 is formed from the tray blank 362 by positioning the exterior surface 361 of the tray blank 362 facing down. First the bottom end flaps 375 and 377 are folded upwardly about fold lines 179, 180 and side panels 168, 169 are fold upwardly about fold lines 171, 173. The attachment flaps 194*a*, 194*b* are positioned in face-to-face contact with the bottom end flaps 375, 377, respectively. Glue can be applied to portions "g" of the attachment flaps 194*a*, 194*b* to adhesively secure the attachments flaps to the side panels 375, 377, respectively and form the tray 364.

Containers C (e.g., bottles) may be loaded into the tray 364. Then the receptacles 123 of the retainer blank 204 are aligned with the caps CP of the container and the retainer blank is pushed down over the tops of the containers, or alternatively the containers can be moved relative to the blank 204 and inserted into the receptacles 123. As the caps CP of the containers C enter the receptacles 123, the caps contact the support tabs 125 and pivot the support tabs up relative to the top panel 113 to further open the openings 109 in the top panel. Relative upward movement of the containers C continues until the support tabs 125 snap into place as the edges of these tabs engage the underside of the flanges F. Next, the top end flaps 215, 217 are folded down about tear lines 119, 121 and into face-to-face contact with the bottom end flaps 375, 377, respectively. Glue can be applied to portions "g" of the bottom end flaps 375, 377 to adhesively secure the bottom end flaps 375, 377 to the top end flaps 215, 217, respectively, to produce the final carton 300. Alternatively the top retainer 206 can be formed and the containers added or attached prior to loading the containers in the tray 364.

Figure 7A:
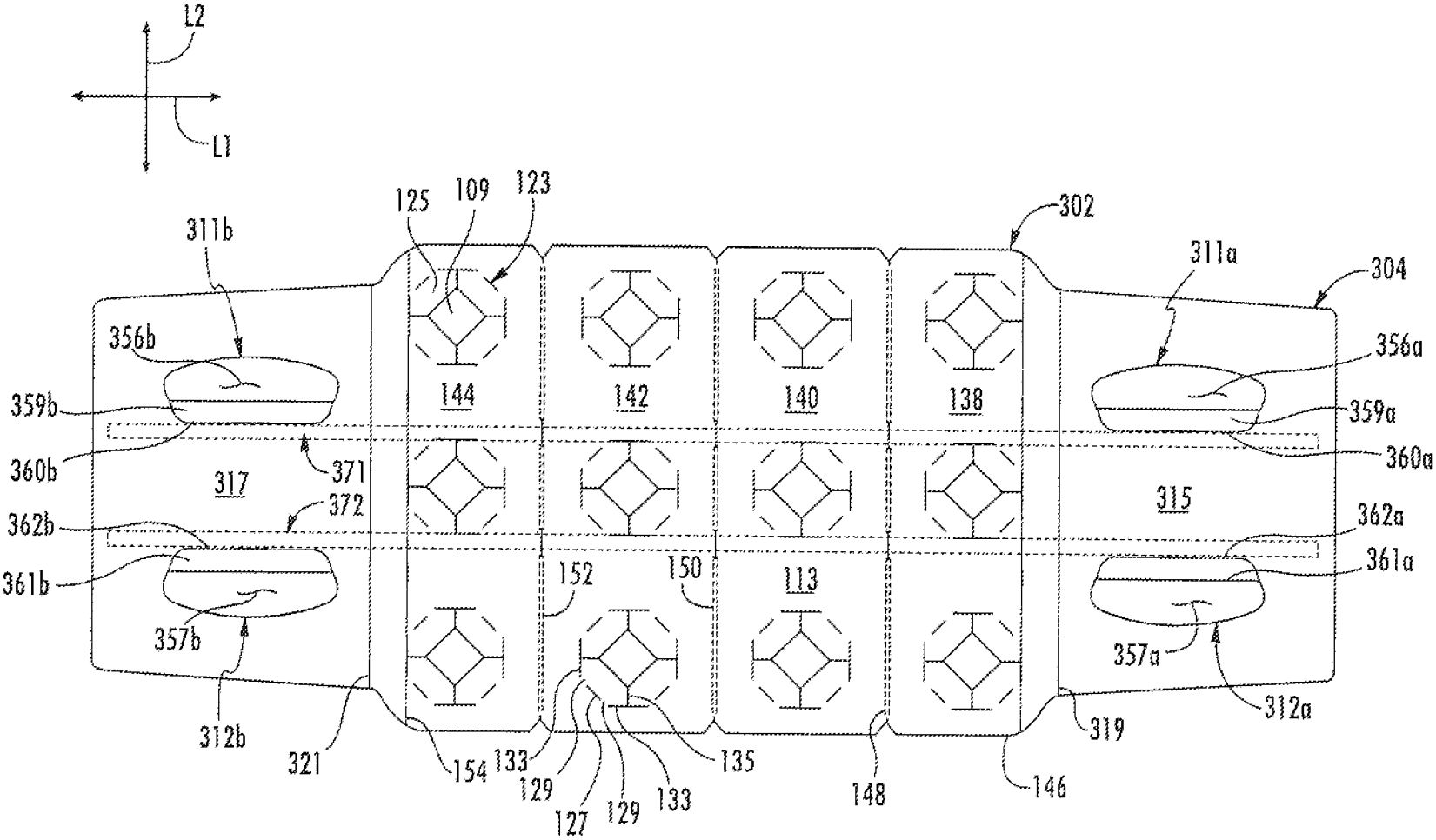

FIG. 7A is a plan view of the exterior side 302 of a blank, generally indicated at 304, used to form the top retainer 306 of a carton 400 (FIG. 7B) according to a fourth embodiment of the disclosure. Accordingly, similar or identical features of the embodiments are provided with like reference numbers. The blank 304 has a longitudinal axis L1 and a lateral axis L2. The blank 304 comprises a top panel 113 removably connected to first and second top end flaps 315, 317 at lateral tear lines 119, 121, respectively.

In the illustrated embodiment, the blank 304 includes handle features for forming the handles 311*a*, 311*b*, 312*a*, 312*b* in the carton 400. The handle features for forming the handle 311*a*, 311*b* include first and second handle openings 356*a*, 357*a* in the first top end flap 315 and reinforcement flaps 359*a*, 361*a* foldably connected to the first top end flap at longitudinal fold lines 360*a*, 362*a*, respectively. The handle features for forming the handles 311*b*, 312*b* include first and second handle openings 356*b*, 357*b* in the second top end flap and reinforcement flaps 359*b*, 361*b* foldably connected to the second top end flap 317 at longitudinal fold lines 360*b*, 362*b*, respectively. The handle features may also include first and second reinforcing string (e.g., reinforcing tear tape) 371, 372 on the interior side of the blank adjacent the fold lines 360*a*, 360*b* and 362*a*, 362*b*, respectively; and may extend longitudinally across substantially the entire length of the retainer blank 304. The reinforcing string prevents tearing of the handle and may include cuts or nicks associated with the tear lines 148, 150 and 152 to allow for removal of the retaining portions (138, 140, 142, and 144). The reinforcing string 371, 372 may be used to reinforce low caliper materials; however the reinforcement sting 371, 372 is not required. The handle features could be otherwise shaped, arranged, configured, and/or omitted without departing from the disclosure.

An exemplary method of forming the carton 400 comprising the top retainer 306 and tray 164 is discussed in detail below. At various stages in the method for forming, respective portions of the retainer blank 304 and the tray blank 162 are mounted to one another in any suitable manner. For example, at various stages of the carton forming process, glue or other adhesive material can be applied at various portions of the blanks 304, 162. The adhesive material may be indicated by "g" and/or present where appropriate surfaces of the blank are in face-to-face contact.

To form the carton 400 in accordance with one acceptable method, the tray 164 is formed from the tray blank 162 by positioning the exterior surface 161 of the tray blank 162 facing down. First the bottom end flaps 175 and 177 are folded about fold lines 179, 180 and side panels 168, 169 are fold about fold lines 171, 173. The attachment flaps 194*a*, 194*b* are positioned in face-to-face contact with the bottom end flaps 175, 177, respectively. Glue may be applied to portions "g" of the attachment flaps 194*a*, 194*b* to adhesively secure the attachments flaps to the side panels 175, 177, respectively and form the tray 164.

Figure 7B:
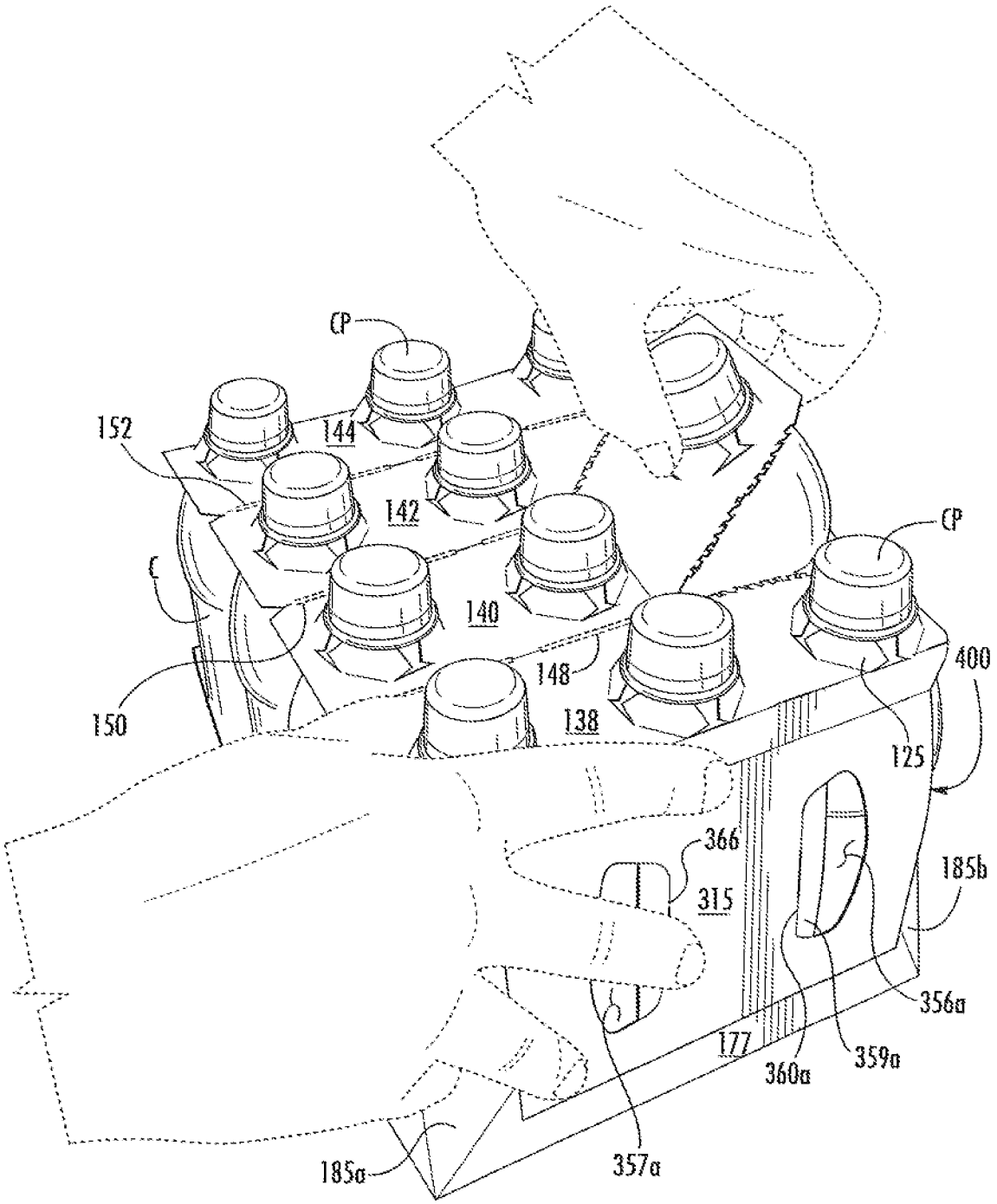
Figure 7C:
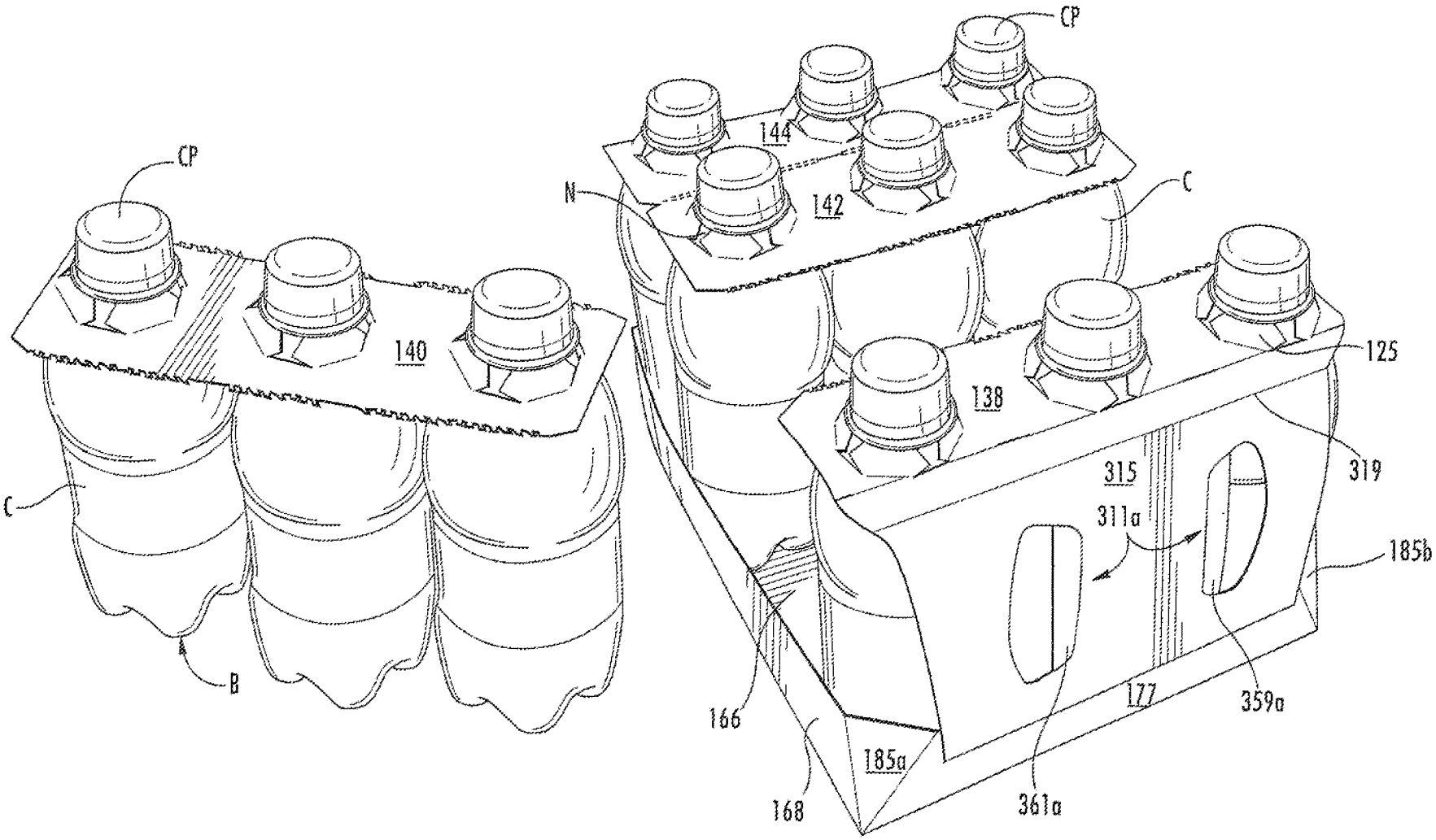

Containers C (e.g., bottles) may be loaded into the tray 164. Then the receptacles 123 of the retainer blank 304 are aligned with the caps CP of the container and the retainer blank is pushed down over the tops of the containers, or alternatively the containers can be moved relative to the blank 304 and positioned or inserted into the openings 109 of the receptacles 123. As the caps CP of the containers C enter the receptacles 123, the caps contact the support tabs 125 to pivot the support tabs up relative to the top panel 113 to further open the openings 109 in the top panel. Relative upward movement of the containers C continues until the support tabs 125 snap into place as the edges of these tabs engage the underside of the flanges F. Next, the top end flaps 315, 317 are folded downwardly about tear lines 319, 321 and positioned into face-to-face contact with the bottom end flaps 175, 177, respectively. Glue can be applied to portions "g" of the bottom end flaps 175, 177 to adhesively secure the bottom end flaps 175, 177 to the top end flaps 315, 317, respectively, to produce the final carton 400 (FIG. 7B). Alternatively the top retainer 306 can be formed and attached to the containers prior to loading the containers in the tray 164.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

In accordance with the exemplary embodiments of this disclosure, a fold line can be any substantially linear, although not necessarily straight, form of weakening that facilitates folding therealong. More specifically, but not for the purpose of narrowing the scope of this disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue. The term "glue" is intended to encompass all manner of adhesives commonly used to secure carton panels or flaps in place.

The foregoing description of the disclosure illustrates and describes various exemplary embodiments. Various additions, modifications, changes, etc., could be made to the exemplary embodiments without departing from the spirit and scope of the invention as set forth in the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the claims, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of forming a carton for holding a plurality of containers, the method comprising:

obtaining a top retainer blank comprising a top panel and at least one top end flap foldably connected to the top panel, the top panel comprises at least one retaining portion having at least one receptacle for retaining at least one container of the plurality of containers, the at least one retaining portion comprising a first retaining portion and a second retaining portion, the at least one receptacle comprises a first receptacle of the first retaining portion and a second receptacle of the second retaining portion, the first receptacle has a first opening and the second receptacle has a second opening, the first retaining portion and the second retaining portion are removable from the top retainer blank;

obtaining a tray blank comprising a bottom panel and at least one bottom end flap foldably connected to the bottom panel;

forming a tray from the tray blank;

positioning the plurality of containers on the bottom panel of the tray formed from the tray blank;

forming a top retainer from the top retaining blank and positioning the top retainer and attaching at least one container of the plurality of containers to the at least one retaining portion by contact of the at least one container with a respective receptacle, the first retaining portion being removably connected to each of the top panel and the second retaining portion, the top panel comprising a first tear line removably connecting the top panel to the first retaining portion and a second tear line removably connecting the first retaining portion to the second retaining portion, the first opening and the second opening each being spaced apart from each of the first tear line and the second tear line; and closing an end of the carton by positioning the at least one top end flap and the at least one bottom end flap to form a closed end of the carton.

2. The method of claim 1, further comprising separating the at least one retaining portion from the top retainer.

3. The method of claim 1, wherein the at least one retaining portion comprises a third retaining portion and the top panel comprises a third tear line removably connecting the second retaining portion and the third retaining portion.

4. The method of claim 1, further comprising attaching the at least one container to the at least one retaining portion by positioning the at least one container of the plurality of containers inside the respective opening.

5. The method of claim 4, wherein the at least one receptacle comprises a plurality of support tabs foldably connected to the top panel, the plurality of support tabs each have a free edge adjacent the respective opening.

6. The method of claim 1, wherein the carton comprises a handle in the closed end, the handle comprises a handle opening in the at least one top end flap.

7. The method of claim 6, wherein the handle opening is a first handle opening and the handle comprises a second handle opening in the at least one bottom end flap, and the method further comprises cooperating the first handle opening and the second handle opening to form the handle.

8. The method of claim 7, wherein the closed end is a first closed end, the at least one top end flap comprises a second top end flap and the at least one bottom end flap comprises a second bottom end flap, and the method further comprises cooperating the second top end flap and the second bottom end flap to form a closed second end.

9. The method of claim 8, wherein the handle is a first handle in the first closed end, the carton comprises a second handle in the second closed end, the second handle comprises a third handle opening in the second top end flap and the second handle comprises a fourth handle opening in the second bottom end flap.

10. The method of claim 6, wherein the handle opening comprises a first handle opening and second handle opening in the at least one top end flap.

11. The method of claim 1, wherein the carton comprises a handle in the closed end, the handle comprises a handle opening in the at least one bottom end flap.

12. The method of claim 6, wherein the handle comprises a reinforcement element attached to the at least one top end flap and adjacent the handle opening.

13. The method of claim 1, further comprising a reinforcement element attached to at least one of the top panel and the top end flap for reinforcing the carton.

14. The method of claim 1, wherein the tray further comprises at least one side panel foldably connected to the bottom panel and at least one gusset panel foldably connected to the at least one side panel.

15. The method of claim 1, wherein the first tear line extends across an entire width of the top panel and the second tear line extends across the entire width of the top panel.

16. The method of claim 15, wherein the first tear line is parallel to the second tear line.

* * * * *